United States Patent [19]

Werych

[11] 4,403,329

[45] Sep. 6, 1983

[54] SUPPORT SYSTEM FOR ELECTRICAL RESISTANCE ELEMENT

[75] Inventor: Ewald R. Werych, Elm Grove, Wis.

[73] Assignee: General Signal Corporation, Stamford, Conn.

[21] Appl. No.: 280,745

[22] Filed: Jul. 6, 1981

[51] Int. Cl.[3] ..... H05B 3/06; F27D 1/10

[52] U.S. Cl. ..... 373/130; 373/137

[58] Field of Search ..... 373/128, 130, 137, 119

[56] References Cited

U.S. PATENT DOCUMENTS

| | | | |
|---|---|---|---|
| 4,088,825 | 5/1978 | Carr | 373/137 X |
| 4,154,975 | 5/1979 | Sauder | 373/130 |
| 4,299,364 | 11/1981 | Loniello | 373/128 X |

*Primary Examiner*—Roy N. Envall, Jr.

*Attorney, Agent, or Firm*—Milton E. Kleinman; John F. Ohlandt

[57] ABSTRACT

Disclosed is a support system for an electrical resistance heating element, such element being adapted to be mounted on ceramic fiber insulation covering the inner surfaces of furnace shells or the like. The support comprises a pin for insertion into the ceramic fiber module; and a clip or retaining wire which is held within an opening in the pin and is adapted to surround the resistance element, thereby to retain it in position; means are provided for securely anchoring the pin within the module.

9 Claims, 4 Drawing Figures

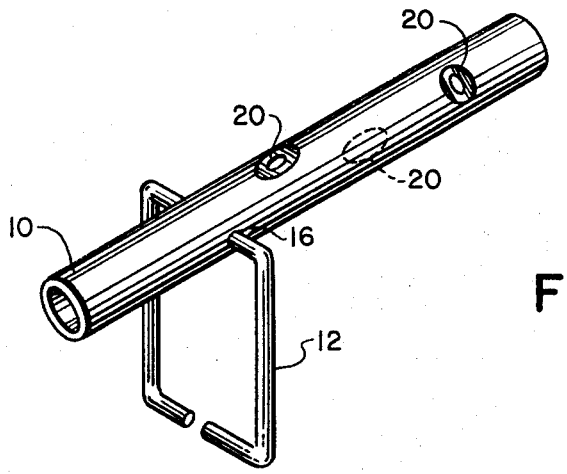
FIG.1
FIG.2
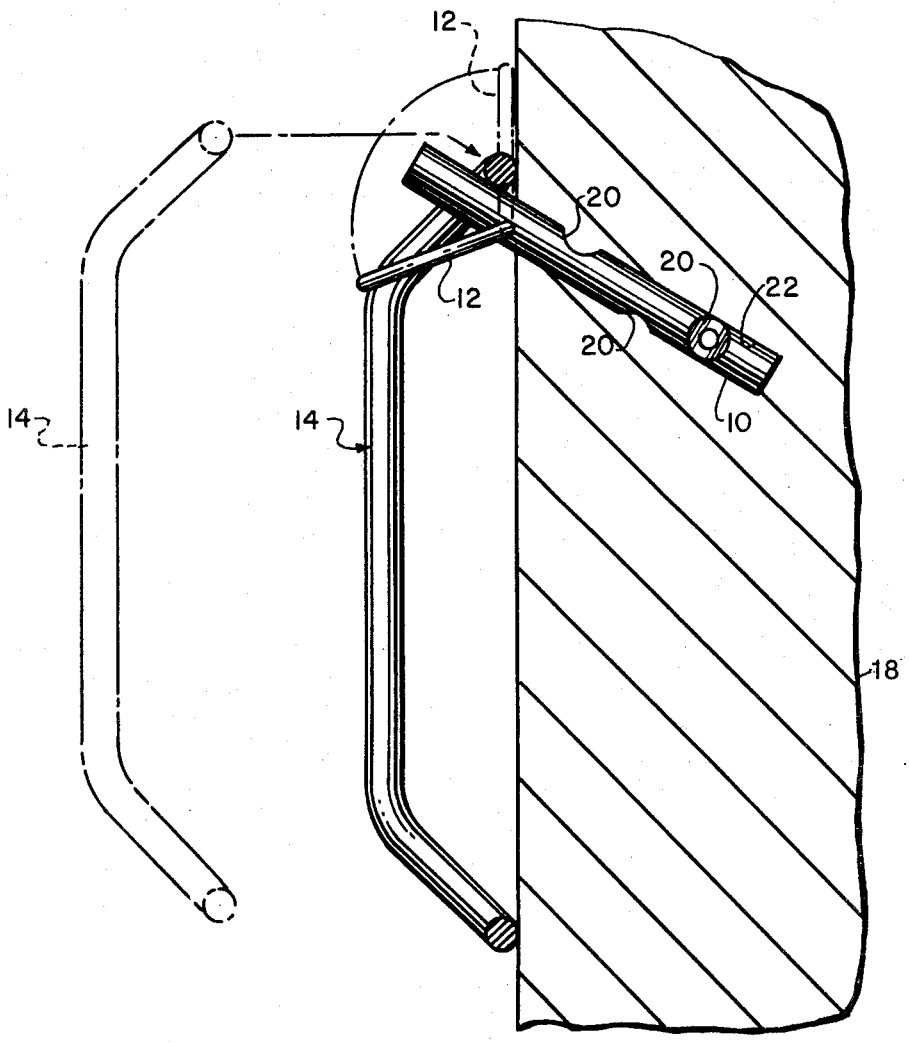

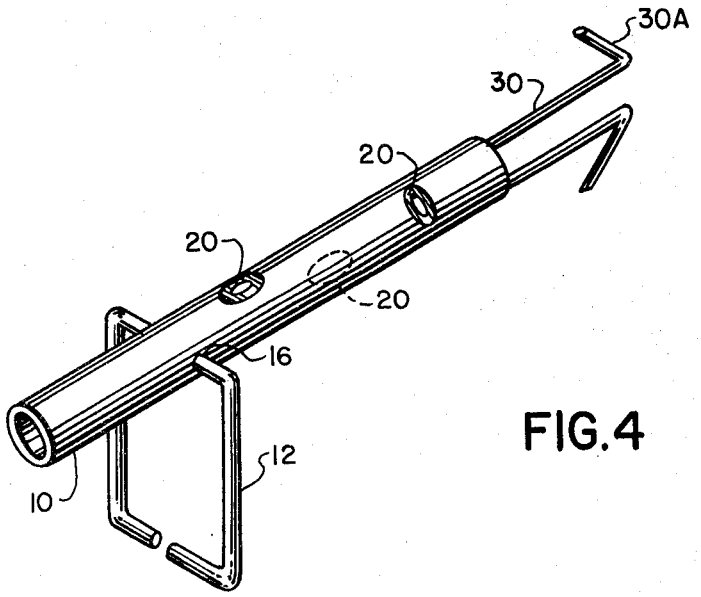
FIG.4
FIG.3
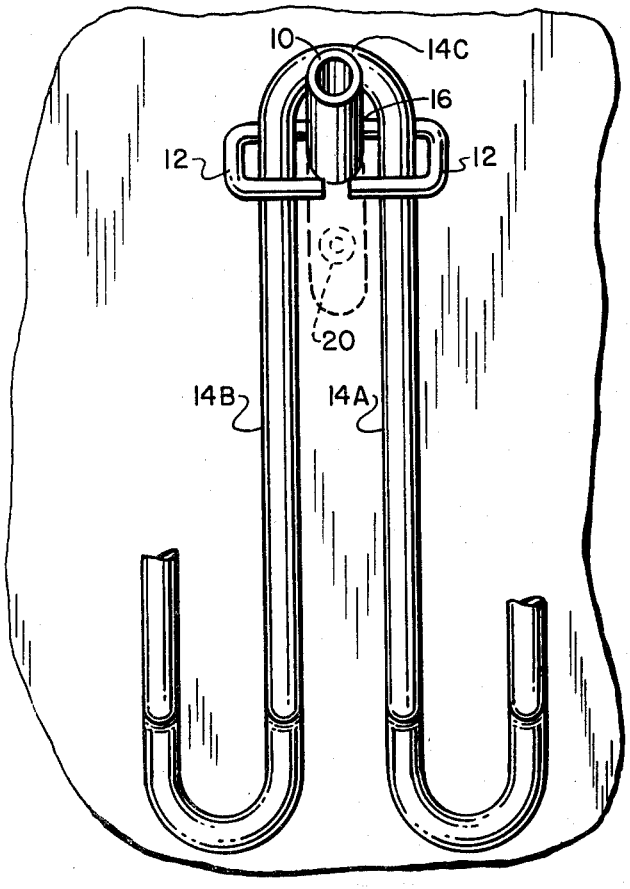

SUPPORT SYSTEM FOR ELECTRICAL RESISTANCE ELEMENT

BACKGROUND OF THE INVENTION

1. Field of the Invention

This invention relates to support devices for mounting and supporting electrical resistance heating elements of substantial weight.

2. Background Information

Due to the high degree of current interest in energy conservation, industrial heat process furnaces are being designed with lightweight insulation, usually some form of ceramic fiber. More particularly, one variety of such insulation consists of a ceramic fiber blanket material; another type is a so called vacuum formed ceramic fiber insulating module.

In the design of such electrically heated furnace, an essential problem that must be faced is how to mount and support a resistance element wire to the layers of ceramic fiber insulation that cover the interior of the furnaces. To date, most of the ceramic fiber insulation used has been in the first-noted form of blanket layers applied to the inner surfaces of the furnace shell.

The electric resistance elements are designed in various configurations, the most popular of which is a formed rod of resistant material in the shape of a reversed bend arrangement which must be supported or suspended from the side walls of the insulating material. Since the electric resistance element is of substantial weight, the supporting mechanism tends to become quite complicated, due in part to the fact that these elements cannot be grounded to the furnace's outer steel shell.

One particular form of mounting that is known may be appreciated by referring to a brochure which describes "PYRO-BLOC ELECTRIC ELEMENT SYSTEMS" of Saunders Industries, which is a major producer of fiber-lined furnaces. This element hanger system is useful as a basis of comparison with the present invention. It should be noted that the hanger system described in the brochure or article is adapted to be used with furnace linings consisting of the previously noted refractory or fiber blanket material. Such system involves the use of a ceramic tubing or rods which are buried in the refractory fiber blanket, the tubing being engaged by hooks on a series of spaced rods whose other ends have similar hooks engaging the spaced reverse bend loops of the electric resistance elements.

On the other hand, applicant's invention is particularly adapted to be utilized with the formed ceramic fibers insulating modules sold under the trademark "MOLDATHERM" (owned by Lindberg, Inc., a unit of General Signal). The reason that applicant's invention is especially adapted to the aforenoted modules is that these are produced in approximately 13 pounds per cubic foot density as compared to the ceramic blanket at 6–8 pounds per cubic foot. These ceramic modules are held in shape by a binder which imparts far greater mechanical strength to the refractory fiber and therefore will support the weight of such electrical elements as described.

Accordingly, it is a primary object of the present invention to provide an extremely simple support for an electrical resistance element.

Another object, by reason of the simplicity, is to reduce substantially the cost of the support.

SUMMARY OF THE INVENTION

In fulfillment of the previously stated objects, it is a primary feature of the present invention to provide an extremely simple support system or mechanism for an electrical resistance heating element, comprising a pin adapted to be inserted into a ceramic fiber module of insulative material. The support mechanism also includes a retaining wire formed to hold the reverse bend loop of the electrical resistance heating element on the support pin, such retaining wire surrounding the loop. Further provided are means for securely anchoring said pin within the ceramic fiber module.

In one specific embodiment the retaining wire extends through and is held within an opening in the pin. A second embodiment includes a retaining wire but it further provides a special wire formed clip, the ends of which are compressed and slid partially into the hollow pin or tube. The retainer wire is conveniently installed through the clip with the result that there is an anchor point when the wire slip is pushed down as far as it will go.

Other and further objects, advantages and features of the present invention will be understood by reference to the following specification in conjunction with the annexed drawing, wherein like parts have been given like numbers.

BRIEF DESCRIPTION OF DRAWING

FIG. 1 is a perspective view of the support or support device in accordance with the first embodiment of the present invention.

FIG. 2 is a side elevational view of the complete support system of the present invention, depicting the electrical resistance element being held by the support which is embedded in the ceramic fiber module.

FIG. 3 is a front elevational view of the complete system.

FIG. 4 is a second embodiment of the support device and is similar to that shown in FIG. 1 except that a clip element is included and may be seen emerging from the inner end of the tube.

DESCRIPTION OF PREFERRED EMBODIMENTS

Referring now to the figures of the drawing and for the moment in particular to FIG. 1, there will be seen a first embodiment of a support device in accordance with the present invention. A hanger support pin in the form of a simple tube 10 is seen therein. This tube is preferably composed of an alloy material known as alloy 600, and typically having an outside diameter of $\frac{3}{8}$ inches and a wall size of approximately 0.028 inches. Such a construction is used in order to minimize mass and heat conduction.

Also provided as part of the support device is a retaining wire 12 which functions to hold the electric resistance heating element 14 (FIG. 3) on the support pin. Thus the retaining wire 12 surrounds the legs 14A and 14B while the reverse bend loop 14C extends over and engages the outer end of tube 10. This wire 12 is fitted through an opening 16 which extends through the tube 10 at a point selected to be close to the ceramic fiber module 18 when the tube has been installed.

It will be especially noted that the tube 10 has a number of spaced notches or openings 20; in this particular case, three notches are ground into the tube 10 in random places along the length of the tube at the inner or bottom end thereof. These openings cause the cement to lock the tube from within, since the cement will flow through the openings to the inside of the tube.

It will be understood that since ceramic fiber insulation shrinks at elevated temperatures and the metallic elements are subject to considerable movement due to expansion and contraction, it is necessary to have the support pin or tube such as the tube 10 anchored so as to prevent pulling out of the module 18. The tube 10, as seen in the first embodiment, particularly in FIG. 2, is mounted in the module 18 by boring a 5/16 inch hole on an angle, for example approximately 30 to 45 degrees from the horizontal, into the module. It was found that good anchoring was obtained by pouring liquid binder such as colloidal silica into the hole 22 so as to partially fill it, and then completely filling with cement.

A number of tests were performed on the embodiment of FIG. 2, the module 18 being heated to 1500° F. to shrink it and cure the cement. These vacuum formed refractory fiber modules were supported on a wooden fixture designed so that the weight applied to each pin or tube 10 would pull straight down. It was found that the pin or tube seen in FIG. 2 would hold 100 pounds. The test was not as long as one conducted on another embodiment, but since this design is less expensive to manufacture than that other embodiment, it is the most preferred from the cost standpoint. In any event it did hold 100 pounds in the manner described.

Referring now to FIG. 4, that other embodiment just mentioned is herein depicted. This embodiment is preferred in those cases where it becomes necessary to support the heating element from a roof mounted ceramic module or the like. In this embodiment, in addition to the notches 20 formed in the tube, a special wire formed clip 30 is included. This clip has its ends compressed so that the clip can be slid partially into the tube 10. The retainer wire 12 is installed through the opening 16, and the wire clip is pushed down as far as it will go, being caught by the retainer wire. The compressed ends 30A of the clip emerge from the lower or bottom end of tube 10 and expand into the wetted module 18. Typically the bent ends of the clip, that is the ends 30A are approximately an inch long and extend outwardly about ⅝ of an inch or so. The support tube of the FIG. 4 embodiment was the strongest tube tested since it held 100 pounds for sixteen days and would certainly have held longer.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

I claim:

1. A support device for an electrical resistance heating element having a reverse bend loop therein, said heating element being adapted to be mounted on a ceramic fiber insulation module covering the inner vertical walls of furnace shells, said support device comprising:

a pin for insertion into said module downwardly at an acute angle from the horizontal;

a retaining wire held within an opening in said pin, said retaining wire surrounding the legs defining the reverse bend loop in said resistance element so as to retain the element in position with respect to the module, the reverse bend loop extending over said pin;

means for securely retaining said pin within said module.

2. A support device as defined in claim 1, in which said pin is a hollow tube.

3. A support device as defined in claim 1, in which said opening is located near the outer end of said pin such that the retaining wire is outside the module when the pin is installed.

4. A support device as defined in claim 1, in which said means for securely anchoring includes notches for receiving cement or the like, said notches being spaced along the length of said pin.

5. A support device as defined in claim 4, in which said notches are located within said module when said pin is installed.

6. A support device as defined in claim 5, in which a clip is provided for insertion within the inner end of said tube, said clip extending with reverse bend loops outside the tube.

7. A system or apparatus for supporting an electrical resistance element adapted to be mounted on a ceramic fiber module, said apparatus comprising:

an electrical resistance heating element;

a ceramic fiber module;

a pin for insertion into said module;

a retaining wire held within an opening in said pin, said retaining wire being adapted to surround the resistance heating element so as to retain the element in position;

means for securely anchoring said pin within said module, including notches spaced along the length of said pin;

said ceramic fiber module having an opening sized to fit said pin, said pin being disposed therein;

and cement inside said module opening.

8. A system as defined in claim 7, in which said module has a density of approximately thirteen pounds per cubic foot.

9. A system as defined in claim 7, in which said notches are located within said module when said pin is installed.

* * * * *